US008455798B2

(12) United States Patent
Akdag et al.

(10) Patent No.: US 8,455,798 B2
(45) Date of Patent: Jun. 4, 2013

(54) OVEN

(75) Inventors: Levent Akdag, Istanbul (TR); Asli Kayihan, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 258 days.

(21) Appl. No.: 12/742,656

(22) PCT Filed: Nov. 11, 2008

(86) PCT No.: PCT/EP2008/065253

§ 371 (c)(1),
(2), (4) Date: May 12, 2010

(87) PCT Pub. No.: WO2009/062917

PCT Pub. Date: May 22, 2009

(65) Prior Publication Data

US 2011/0100977 A1 May 5, 2011

(30) Foreign Application Priority Data

Nov. 12, 2007 (TR) ..... A2007/07755

(51) Int. Cl.
*A21B 1/00* (2006.01)

(52) U.S. Cl.
USPC ..... 219/413; 219/414

(58) Field of Classification Search
USPC ..... 219/414, 413
See application file for complete search history.

(56) References Cited

U.S. PATENT DOCUMENTS 6,299,921 B1 * 10/2001 Loffler et al. ..... 426/233

FOREIGN PATENT DOCUMENTS

| | | | |
|---|---|---|---|
| CH | 678996 | A5 | 11/1991 |
| DE | 19718399 | A1 | 11/1998 |
| DE | 19839008 | A1 | 3/2000 |
| DE | 102004061304 | A1 | 6/2006 |
| DE | 102005011304 | A1 | 9/2006 |
| EP | 1195560 | A1 | 4/2002 |
| EP | 1213542 | A2 | 6/2002 |

* cited by examiner

*Primary Examiner* — Richard Booth
(74) *Attorney, Agent, or Firm* — Venable, Campillo, Logan & Meaney PC

(57) ABSTRACT

The present invention relates to an oven (1) comprising a cooking chamber (2) wherein the cooking process is performed, a heater (3) for cooking the foodstuffs emplaced in the cooking chamber (2), a thermostat that controls the operation of the heater (3) and a control unit (4) that regulates the cooking parameters of temperature and duration such that energy savings is maintained at different temperature values (T1) defined by the user such as 160° C., 180° C., 200° C., 220° C., . . . according to type of food to be cooked.

15 Claims, 2 Drawing Sheets

OVEN

Figure 1:
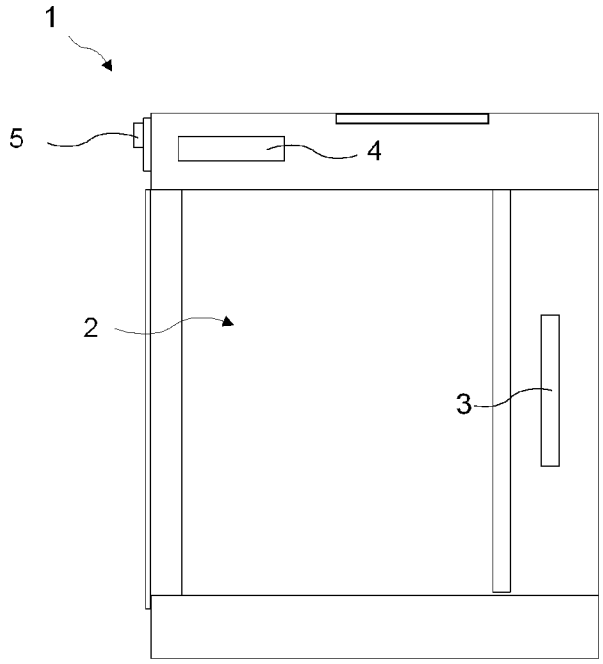

The present invention relates to an oven wherein energy savings is provided in the cooking process.

In domestic type ovens, for example in ovens wherein electric heaters are used, energy consumption value is aimed to be kept low and precautions are taken intended for saving energy. The insulation properties of the oven door and walls are improved for keeping the heat generated by the heaters inside the oven and thus provide energy savings, elements for reflecting heat or absorbing heat inside the oven are used or different types of heaters are used in the oven. The energy consumption in ovens varies according to the duration the heater operates during the cooking time. In order to use energy efficiently, the heaters are turned off for a certain time during or after the cooking process for making use of the heat stored in the oven. In cooking programs aiming at energy savings, the cooking duration is prolonged and the desired cooking quality cannot be maintained if the operation times of heaters are kept shorter than necessary.

The state of the art Patent Document No CH678996 relates to an oven wherein the heaters are turned off for a certain time before the cooking duration ends for reducing energy consumption. In the oven, the thermal capacity of the oven and components are utilized at the end of the cooking process. Since the heaters operate for a shorter time, the energy consumption is reduced and the total cooking duration is prolonged a certain amount.

In the state of the art Patent Document No EP1213542, in an oven when a stable condition is reached at the defined cooking temperature, the heaters are turned off until the interior temperature of the oven falls down to a certain value. Upon reaching this predetermined temperature, the heaters are turned on again for reaching the stable set temperature. The residual heat of the oven is utilized until reaching the predetermined low temperature and energy consumption of the oven is reduced. The suggested low temperature value when the heaters are off is around 100 C. The reason for selecting this temperature when the heaters start to operate again is that water evaporates at around 100 C and hence cooking can continue.

The aim of the present invention is the realization of an oven wherein the desired cooking performance is provided together with savings in energy.

The oven realized in order to attain the aim of the present invention is explicated in the claims.

In the oven of the present invention, at least a three phase cooking process is employed by the control unit from start until the end of cooking according to the temperature set by the user at the start of the cooking process. After implementing cooking for a predetermined amount of time at the temperature set by the user in the first phase, cooking is performed at a temperature lower than the temperature set by the user in the second phase and energy is saved in this phase since less energy is transmitted to the heaters. In the third phase, the temperatures of the heaters are raised again for improving cooking quality.

In the oven of the present invention, as the different temperatures initially set by the user according to type of food to be cooked increase and decrease, the temperature values in the second and third phases are increased or decreased by the control unit in direct proportion with the initial set temperatures. The higher the initial set temperature, the temperatures in the second and third phases are that much higher respectively; and the lower the initial set temperature, the temperatures in the second and third phases are that much lower respectively. Thus, there are not great differences between the implemented cooking temperatures from start till end of cooking and cooking quality does not decrease.

Moreover, in the oven, the duration values in the second and third phases of cooking are increased or decreased by the control unit inversely proportional with the initial temperatures. The higher the initial set temperature, the durations of the second and third phases are that much shorter, the lower the initial set temperature, the durations of the second and third phases are that much longer. For example, if a high temperature is set by the user at the start of the cooking process, the desired cooking quality is achieved since the temperatures in the second and third phases will also be high; however, the cooking durations at the second and third phases will be shortened to save energy since more energy will be consumed due to high temperatures at each phase.

In an embodiment of the present invention, the control unit calculates the temperature and duration values of the second and third phases as a function of the initially set temperatures after the first phase. These functions can be defined by first degree and second degree equations.

In the oven, after the temperatures for second and third phases and the durations for these phases are determined by the control unit, the heater is operated in an on-off cycle by the thermostat after getting close to the determined temperatures in the second and third phases and the oven set temperature oscillates between the temperatures calculated by the control unit.

In another embodiment of the present invention, the oven comprises an economy mode button for implementing an economic cooking program after the first phase of the cooking process as per the choice of the user wherein the temperatures and durations are increased or decreased in the successive cooking phases depending on the initial set temperature by the control unit. The user, if wanting to cook economically, sets the temperature at the start of the cooking process and starts the cooking process by pressing the economy mode button.

In the oven of the present invention, the temperature and duration parameters in the second and third phases of the cooking process at low and high temperatures are defined only by the functions of the initial temperatures set by the user, and energy savings and a high cooking quality are provided for each initial temperature the user can set within a wide range.

The oven realized in order to attain the aim of the present invention is illustrated in the attached figures, where:

FIG. 1—is the schematic view of an oven.

Figure 2:
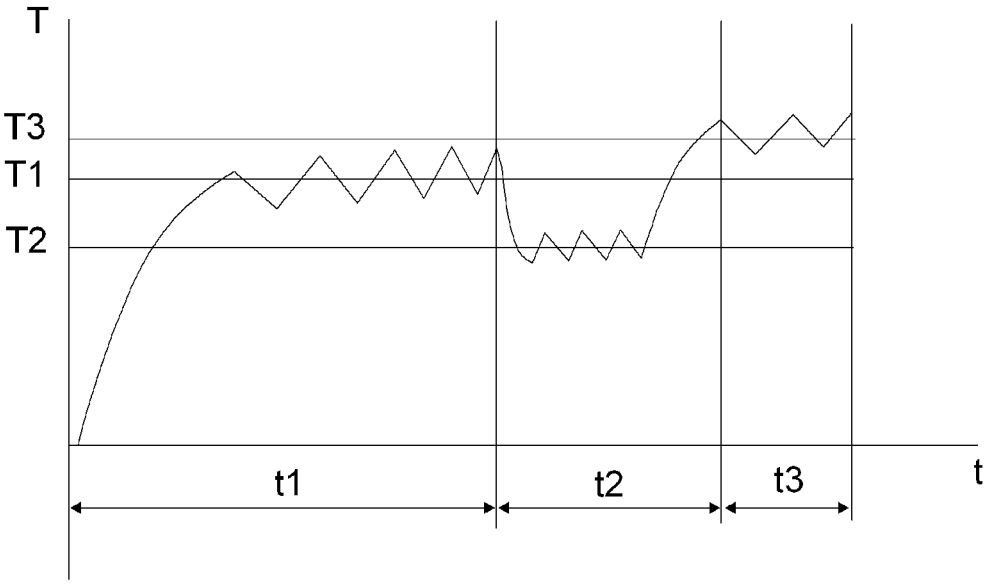

FIG. 2—is the graph showing the change in oven temperature and the energy consumption with respect to time in an oven.

Figure 3:
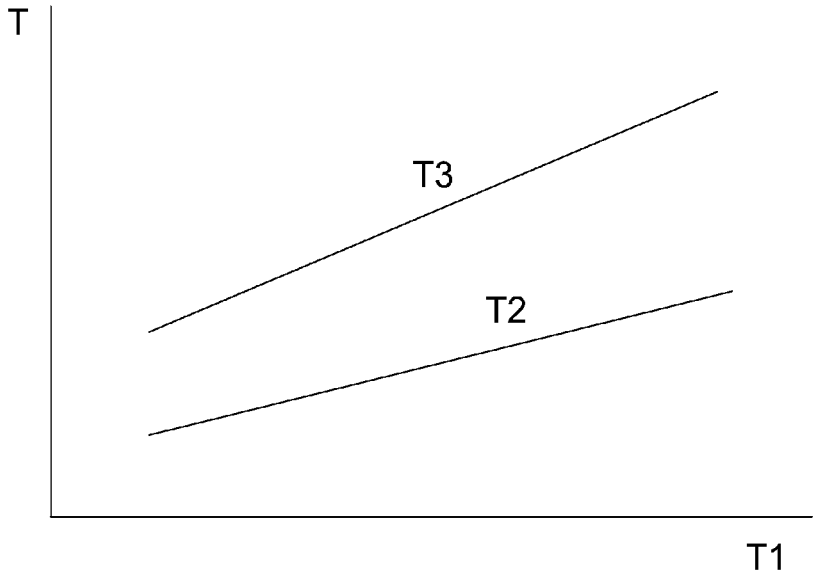

FIG. 3—is the graph showing the change in temperatures in the progressive phases with respect to the initial set temperature in an oven.

Figure 4:
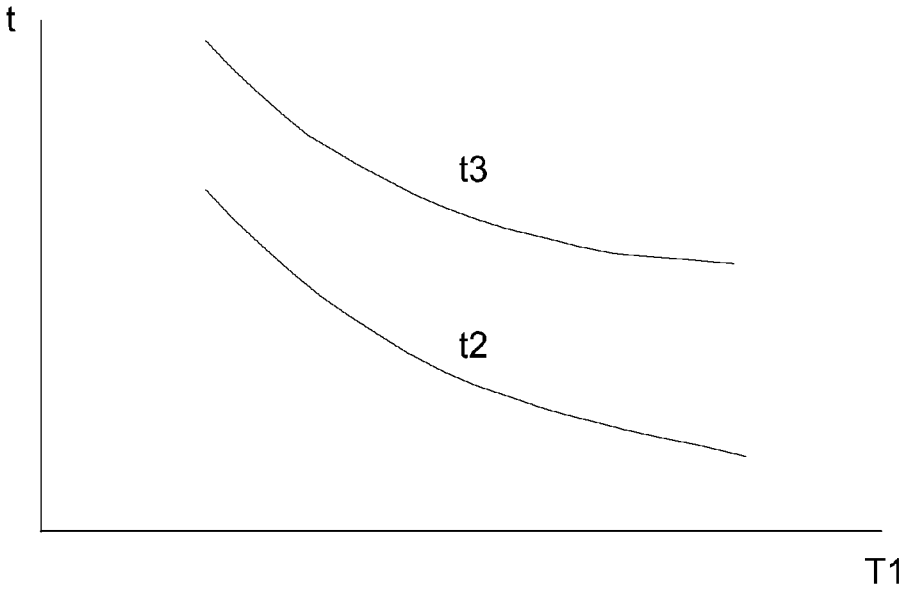

FIG. 4—is the graph showing the change in implementation times of temperatures in the progressive phases with respect to the initial set temperature in an oven.

The elements illustrated in the figures are numbered as follows:

1. Oven
2. Cooking chamber
3. Heater
4. Control unit
5. Economy mode button The oven (1) comprises a cooking chamber (2) wherein the cooking process is performed, a heater (3) for cooking the foodstuffs emplaced in the cooking chamber (2), a thermostat that controls the operation of the heater (3) and a control unit (4) for regulating the cooking process according to a set temperature value (T1) defined by the user such as 160° C., 180° C., 200° C., 220° C., . . . according to type of food to be cooked at the start of the cooking process.

After the cooking process is started by setting of the temperature value (T1) by the user, the heater (3) operates uninterrupted with maximum power until reaching the approximate temperature (T1) in the cooking chamber (2) and after reaching the approximate temperature (T1), is operated in an on-off cycle within the range determined by the thermostat. Thus, the oven (1) interior temperature oscillates around the set temperature (T1) and becomes stable.

In the oven (1) of the present invention, at least a three phase cooking process is implemented by the control unit (4) from start till end of cooking for saving energy.

For example, when a three phase cooking process is implemented, in the first phase cooking is employed for a predetermined amount of time (t1) at the temperature (T1) set by the user (FIG. 2).

The second phase is for saving energy wherein cooking is performed for a certain amount of time (t2) at a temperature value (T2) lower than the temperature (T1) set by the user (T2<T1) (FIG. 2).

The third phase is for improving the cooking quality, and cooking is performed for a certain amount of time (t3) at a temperature value (T3) higher than the temperatures (T2, T1) set in the second or first phases (T3>T2 or T3>T1) (FIG. 2).

In the oven (1) of the present invention, as the different temperatures (T1) initially set by the user according to type of food to be cooked increase, for example when T1=180° C. is set for food type A and T1=190° C. is set for food type B, the temperature values (T2, T3) in the second and third phases are also increased by the control unit (4) and when the different temperatures (T1) initially set by the user according to type of food to be cooked decrease, the temperature values (T2, T3) in the second and third phases are also decreased (FIG. 3). Since the temperature values (T2, T3) in the second and third phases are increased or decreased accommodating with the initial temperatures (T1), great differences do not form between the cooking temperatures (T1, T2, T3) applied for saving energy in the cooking process thereby cooking quality does not decrease.

In an embodiment of the present invention, the temperature values (T2, T3) in the second and third phases are increased or decreased by the control unit (4) in direct proportion with the different temperatures (T1) initially set by the user.

In the oven (1) of the present invention, moreover, when the different temperatures (T1) initially set by the user according to type of food to be cooked increase, the durations (t2, t3) of the second and third phases are decreased by the control unit (4) and when the different temperatures (T1) initially set by the user according to type of food to be cooked decrease, the durations (t2, t3) of the second and third phases are increased by the control unit (4). For example, if a high temperature value (T1) is set initially by the user, since the temperatures (T2, T3) in the second and third phases will also be high, the intended cooking quality is provided, however the cooking durations (t2, t3) at the second and third phases are shortened for saving energy since more energy is consumed due to high temperatures at each phase.

In an embodiment of the present invention, the cooking durations (t2, t3) at the second and third phases are increased or decreased by the control unit (4) inversely proportional with the different temperatures (T1) initially set by the user.

In another embodiment of the present invention, after the first phase implemented at temperature (T1) and for duration (t1), the control unit (4) calculates the temperature and duration values (T2, T3, t2, t3) to be implemented till the end of cooking in the second and third phases according to the functions of the initially set temperatures (T1) determined by experimental works:

T2=f(T1)

T3=f(T1)

t2=f(T1)

t3=f(T1)

These functions are, for example:

T2=aTt1+b (Linear—first degree) or

T2=a*T12+b*T1+c (Quadratic—second degree)

and the coefficients (a, b) used in these functions and the constants (c) are predetermined by the producer for different working conditions and recorded in the control unit (4).

In the first phase of cooking, depending on the T1 variable, the t2 and t3 durations and the T2 and T3 temperatures are recorded in the control unit (4) as "T1-t2", "T1-t3", "T1-T2", "T1-T3", curves (FIGS. 3, 4). The temperatures and durations (T2, T3, t2, t3) for the second and third phases of cooking for the different initial set temperatures (T1) that can be entered at the start of the cooking process are calculated with the help of the said curves.

In the oven (1), after the temperatures (T2, T3) at the second and third phases and the durations (t2, t3) of these phases are calculated by the control unit (4), the heater (3) operates in an on-off cycle for the duration of (t2), within the range determined by the thermostat, after reaching the approximate temperature (T2) in the second phase and operates in an on-off cycle for the duration of (t3), within the range determined by the thermostat, after reaching the approximate temperature (T3) in the third phase (FIG. 2). Thus, the oven (1) interior temperature in the second and third phases oscillates between the temperatures (T2, T3) calculated by the control unit (4).

The oven (1) furthermore comprises an economy mode button (5) for implementing an economic cooking program as per the request of the user wherein the temperatures and durations (T2, T3, t2, t3) are increased or decreased depending on the initial set temperature (T1) by the control unit (4) after the first phase of the cooking process as included in the above sections explaining the present invention. If the user wants economic cooking, sets the temperature (T1) at the start of cooking and starts the cooking process by pressing the economy mode button (5).

In the oven (1) of the present invention, the temperature (T2, T3) and duration parameters (t2, t3) in the second and third phases of the triple phase cooking process with high and low temperatures are determined by the control unit (4), with the functions relating to the initial set temperatures (T1) defined by the user and energy savings is provided for each temperature (T1) the user can define within a wide range and a good cooking quality is achieved.

The invention claimed is:

1. An oven (1) that comprises a cooking chamber (2) wherein the cooking process is performed, a heater (3) for cooking the foodstuffs emplaced in the cooking chamber (2), and a control unit (4) for implementing at least a three phase cooking process from start till the end of cooking according to a set temperature value (T1) defined by the user at the start of the cooking process, and characterized by a control unit (4) that implements a cooking process wherein cooking is performed in the first phase for a predetermined amount of time (t1) at the temperature (T1) set by the user, in the second phase for an amount of time (t2) at a temperature (T2) lower than the temperature (T1) set by the user (T2<T1) and in the third phase for an amount of time (t3) at a temperature (T3) higher than the temperatures in the second or first phases (T3>T2 or T3>T1), and wherein the control unit (4), calculates the temperature and duration values (T2, T3, t2, t3) in the second and third phases according to the functions of the initially set temperatures (T1), increases the temperature values (T2, T3) in the second and third phases when the different temperatures (T1) initially set by the user according to type of food to be cooked increase, decreases the temperature values (T2, T3) in the second and third phases when the different temperatures (T1) initially set by the user decrease, decreases the durations (t2, t3) of the second and third phases when the different temperatures (T1) initially set by the user decrease, decreases the durations (t2, t3) of the second and third phases when the different tempertures (T1) initially set by the user according to type of food to be cooked increase and increases the durations (t2, t3) of the second and third phases when the different temperatures (T1) initially set by the user decrease.

2. The Oven as in claim 1, wherein the control unit (4) that increases or decreases the temperature values (T2, T3) in the second and third phases in direct proportion with the different temperatures (T1) set by the user.

3. The Oven as in claim 1, wherein the control unit (4) that increases or decreases the cooking durations (t2, t3) in the second and third phases is inversely proportional with the different temperatures (T1) set by the user.

4. The Oven as in claim 1, wherein the heater (3) that operates in an on-off cycle for the duration of (t2), within the range determined by the thermostat, after reaching the approximate temperature (T2) in the second phase and operates in an on-off cycle for the duration of (t3), within the range determined by the thermostat, after reaching the approximate temperature (T3) in the third phase.

5. The Oven as in claim 2, wherein the control unit (4) that increases or decreases the cooking durations (t2, t3) in the second and third phases inversely proportional with the different temperatures (T1) set by the user.

6. The Oven as in claim 5, wherein the control unit (4) that calculates the temperature and duration values (T2, T3, t2, t3) in the second and third phases according to the functions of the initially set temperatures (T1) determined by experimental works.

7. The Oven as in claim 2, wherein the control unit (4) that calculates the temperature and duration values (T2, T3, t2, t3) in the second and third phases according to the functions of the initially set temperatures (T1) determined by experimental works.

8. The Oven as in claim 2, wherein an economy mode button (5) for implementing a cooking program after the first phase of the cooking process as per the request of the user wherein the temperatures and durations (T2, T3, t2, t3) are increased or decreased depending on the initial set temperature (T1) by the control unit (4).

9. The Oven as in claim 3, wherein an economy mode button (5) for implementing a cooking program after the first phase of the cooking process as per the request of the user wherein the temperatures and durations (T2, T3, t2, t3) are increased or decreased depending on the initial set temperature (T1) by the control unit (4).

10. The Oven as in claim 1, wherein an economy mode button (5) for implementing a cooking program after the first phase of the cooking process as per the request of the user wherein the temperatures and durations (T2, T3, t2, t3) are increased or decreased depending on the initial set temperature (T1) by the control unit (4).

11. The Oven as in claim 4, wherein an economy mode button (5) for implementing a cooking program after the first phase of the cooking process as per the request of the user wherein the temperatures and durations (T2, T3, t2, t3) are increased or decreased depending on the initial set temperature (T1) by the control unit (4).

12. The Oven as in claim 5, wherein an economy mode button (5) for implementing a cooking program after the first phase of the cooking process as per the request of the user wherein the temperatures and durations (T2, T3, t2, t3) are increased or decreased depending on the initial set temperature (T1) by the control unit (4).

13. The Oven as in claim 6, wherein an economy mode button (5) for implementing a cooking program after the first phase of the cooking process as per the request of the user wherein the temperatures and durations (T2, T3, t2, t3) are increased or decreased depending on the initial set temperature (T1) by the control unit (4).

14. The Oven as in claim 7, wherein an economy mode button (5) for implementing a cooking program after the first phase of the cooking process as per the request of the user wherein the temperatures and durations (T2, T3, t2, t3) are increased or decreased depending on the initial set temperature (T1) by the control unit (4).

15. The Oven as in claim 1, wherein the control unit (4) that calculates the temperature and duration values (T2, T3, t2, t3) in the second and third phases according to the linear (first degree) or quadratic (second degree) functions of the initially set temperatures (T1).

* * * * *